US007491086B2

(12) United States Patent
Aoki

(10) Patent No.: US 7,491,086 B2
(45) Date of Patent: Feb. 17, 2009

(54) CONNECTOR SYSTEM, PACKAGING STRUCTURE, AND ELECTRONIC DEVICE USING THE SAME

(75) Inventor: Makoto Aoki, Fukaya (JP)

(73) Assignee: Kabushiki Kaisha Toshiba (JP)

( * ) Notice: Subject to any disclaimer, the term of this patent is extended or adjusted under 35 U.S.C. 154(b) by 0 days.

(21) Appl. No.: 11/800,250

(22) Filed: May 4, 2007

(65) Prior Publication Data

US 2007/0281504 A1 Dec. 6, 2007

(30) Foreign Application Priority Data

May 30, 2006 (JP) ..... 2006-150033

(51) Int. Cl.
*H01R 13/60* (2006.01)

(52) U.S. Cl. ..... 439/541.5

(58) Field of Classification Search ..... 439/541.5, 439/78, 862, 857, 947, 76, 65, 68, 69, 74, 439/632, 378, 680, 681, 733.1, 260, 630, 439/629

See application file for complete search history.

(56) References Cited

U.S. PATENT DOCUMENTS

| | | | | |
|---|---|---|---|---|
| RE35,231 | E * | 5/1996 | Wilson | 439/76.1 |
| 6,604,967 | B2 * | 8/2003 | Middlehurst et al. | 439/862 |
| 2004/0235319 | A1 * | 11/2004 | Shimada et al. | 439/78 |

FOREIGN PATENT DOCUMENTS

| | | |
|---|---|---|
| JP | 5-17971 | 3/1993 |
| JP | 6-151020 | 5/1994 |
| JP | 9-35830 | 2/1997 |

* cited by examiner

*Primary Examiner*—Edwin A. Leon
(74) *Attorney, Agent, or Firm*—Knobbe, Martens, Olson & Bear, LLP

(57) ABSTRACT

According to one embodiment, there is provided a connector system having a male connector unit which has a main body and a convex part, and which has first pin terminals provided to the convex part, second pin terminals provided to a contact face contacting an opposite connector, and a plurality of third pin terminals which are provided to side faces, and are respectively connected to the first pin terminals and the second pin terminals, and a female connector unit which has a concave part fitted into the convex part, and which has fourth pin terminals which are provided to the concave part and contact the first pin terminals at the time of fitting into the convex part, and fifth pin terminals connected to the fourth pin terminals.

6 Claims, 8 Drawing Sheets

CONNECTOR SYSTEM, PACKAGING STRUCTURE, AND ELECTRONIC DEVICE USING THE SAME

CROSS-REFERENCE TO RELATED APPLICATIONS

This application is based upon and claims the benefit of priority from Japanese Patent Application No. 2006-150033, filed May 30, 2006, the entire contents of which are incorporated herein by reference.

BACKGROUND

1. Field

One embodiment of the invention relates to a stacking connector system carrying out connections of n-to-n terminals, and in particular, to a connector system having a connect function with respect to a flexible printed circuit board as well.

2. Description of the Related Art

Conventionally, stacking connectors which are capable of connecting n-to-n terminals have been used for a connection of an electronic device, and it is possible to further provide a connect function with respect to a flexible printed circuit board (FPC) to these connectors.

In Patent Document 1 (Jpn. UM. Appln. KOKAI Publication No. 5-17971), there is provided a connector which is capable of carrying out a connection to a printed circuit board, and a connection to a flexible printed circuit board simultaneously. Namely, here, an electrical connection is realized by providing the a flexible printed circuit board between the connecting side faces of the PCB connector.

However, in the conventional art in the Patent Document 1, because an electrical connection to the flexible printed circuit board is realized by providing the flexible printed circuit board between the connecting side faces of the PCB connector, only one to three terminals can be provided to the flexible printed circuit board, and there is the problem that it is impossible to carry out connections to a full-scale flexible printed circuit board of 8-bit, 16-bit, or the like.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, there are provided stacking connectors which are capable of carrying out a connection to a flexible printed circuit board with a great number of connections and high strength.

A connector system according to one embodiment of the present invention comprises: a male connector unit (1) which has a male connector main body (1*a*) and a convex part (1*b*) provided to the main body, and which has first pin terminals (1*d*) provided to the convex part, second pin terminals (1*f*) provided to a contact face (1*e*) contacting an opposite connector of the main body (1*a*), and a plurality of third pin terminals (1*h*) which are provided to side faces (1*g*) different from the contact face of the main body (1*a*), and are respectively connected to the first pin terminals (1*d*) and the second pin terminals (1*f*); and a female connector unit (2) which has a female connector main body (2*a*) and a concave part (2*b*) provided to the main body and fitted into the convex part of the male connector unit, and which has fourth pin terminals (2*c*) which are provided to the concave part and contact the first pin terminals (1*d*) at the time of fitting into the convex part of the male connector unit, and fifth pin terminals (2*d*) which are provided to side faces different from the contact face (2*e*) contacting the male connector unit of the main body (2*a*) and are connected to the fourth pin terminals.

In accordance with the present invention, it is possible to connect to a flexible printed circuit board with a great number of connections and high strength.

Hereinafter, an embodiment of the present invention will be described in detail with reference to the drawings.

Figure 1:
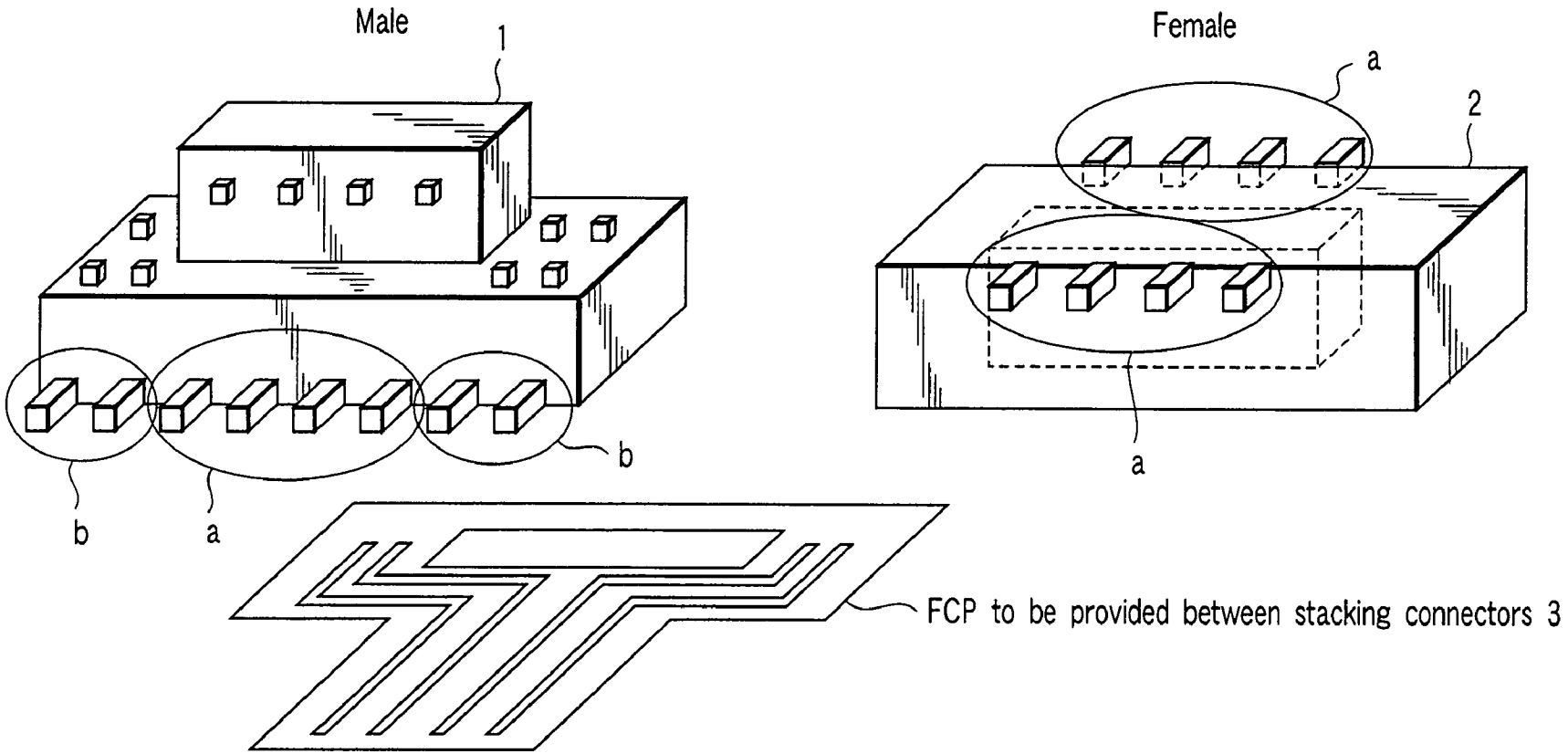
FIG. 1 is an appearance diagram showing one example of stacking connectors according to one embodiment of the present invention.
Figure 2:
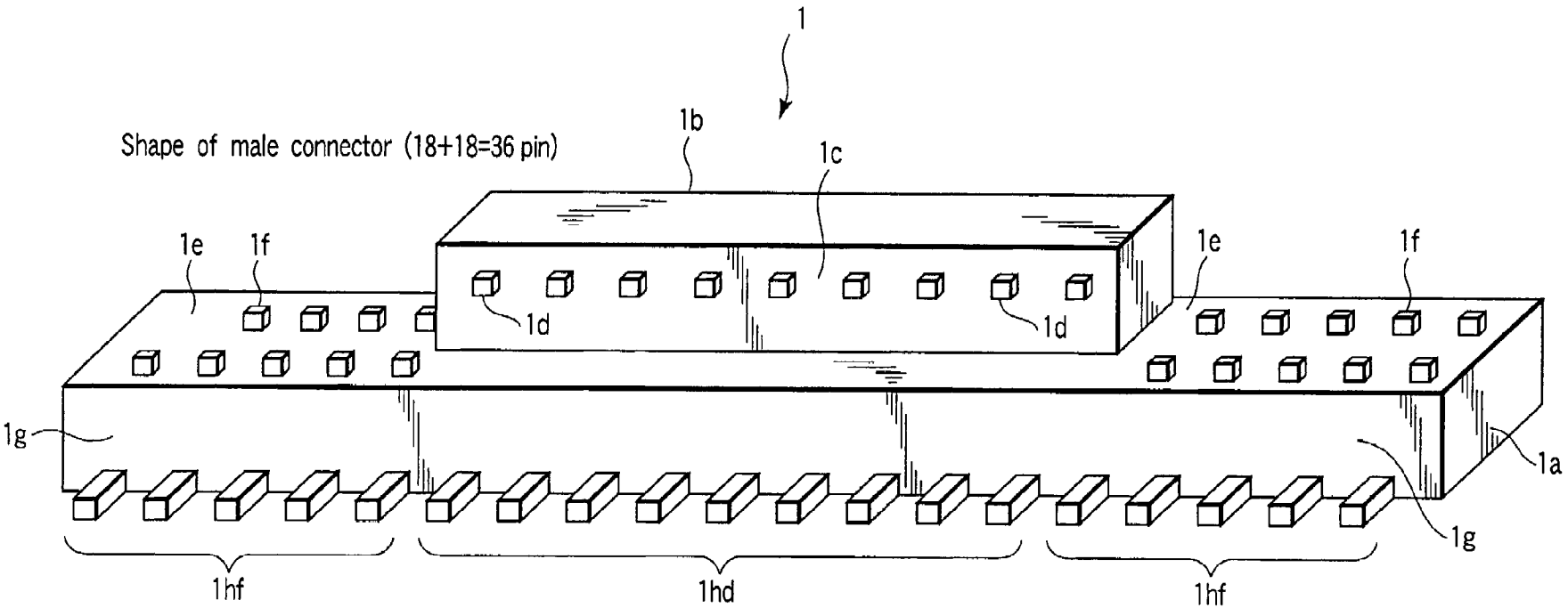
FIG. 2 is an appearance diagram showing one example of a male stacking connector according to one embodiment of the present invention.
Figure 3:
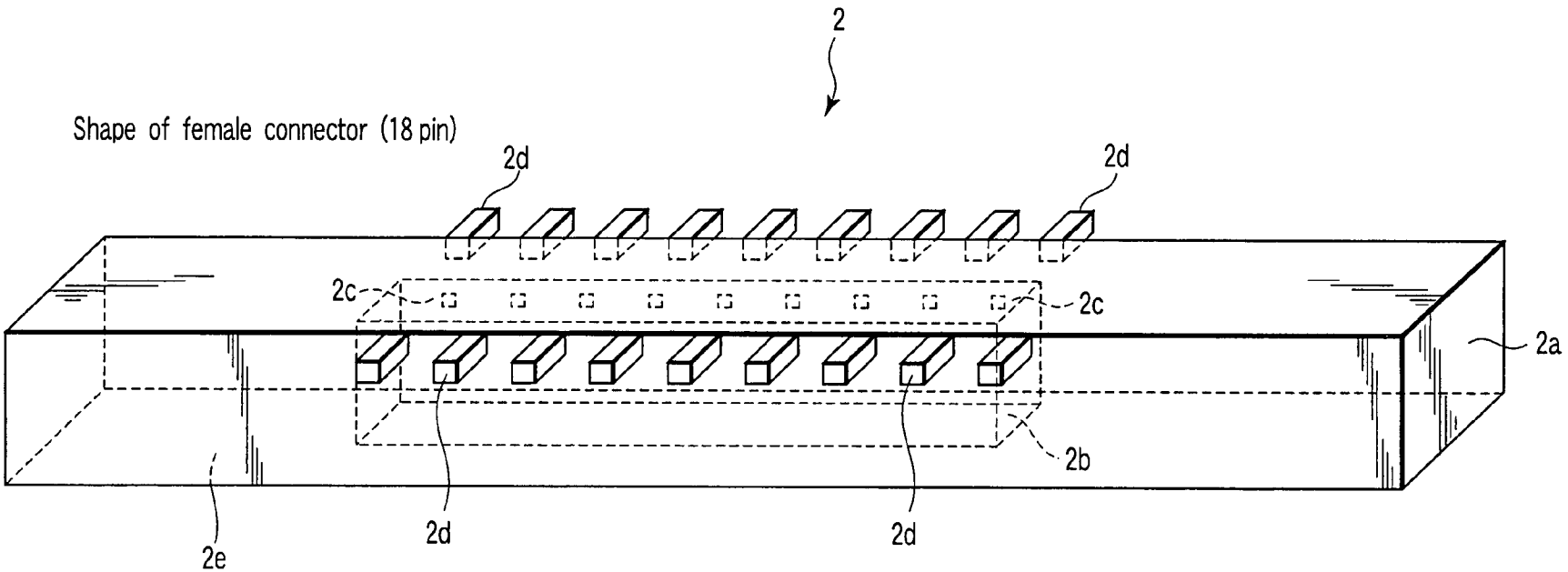
FIG. 3 is an appearance diagram showing one example of a female stacking connector according to one embodiment of the present invention.
Figure 4:
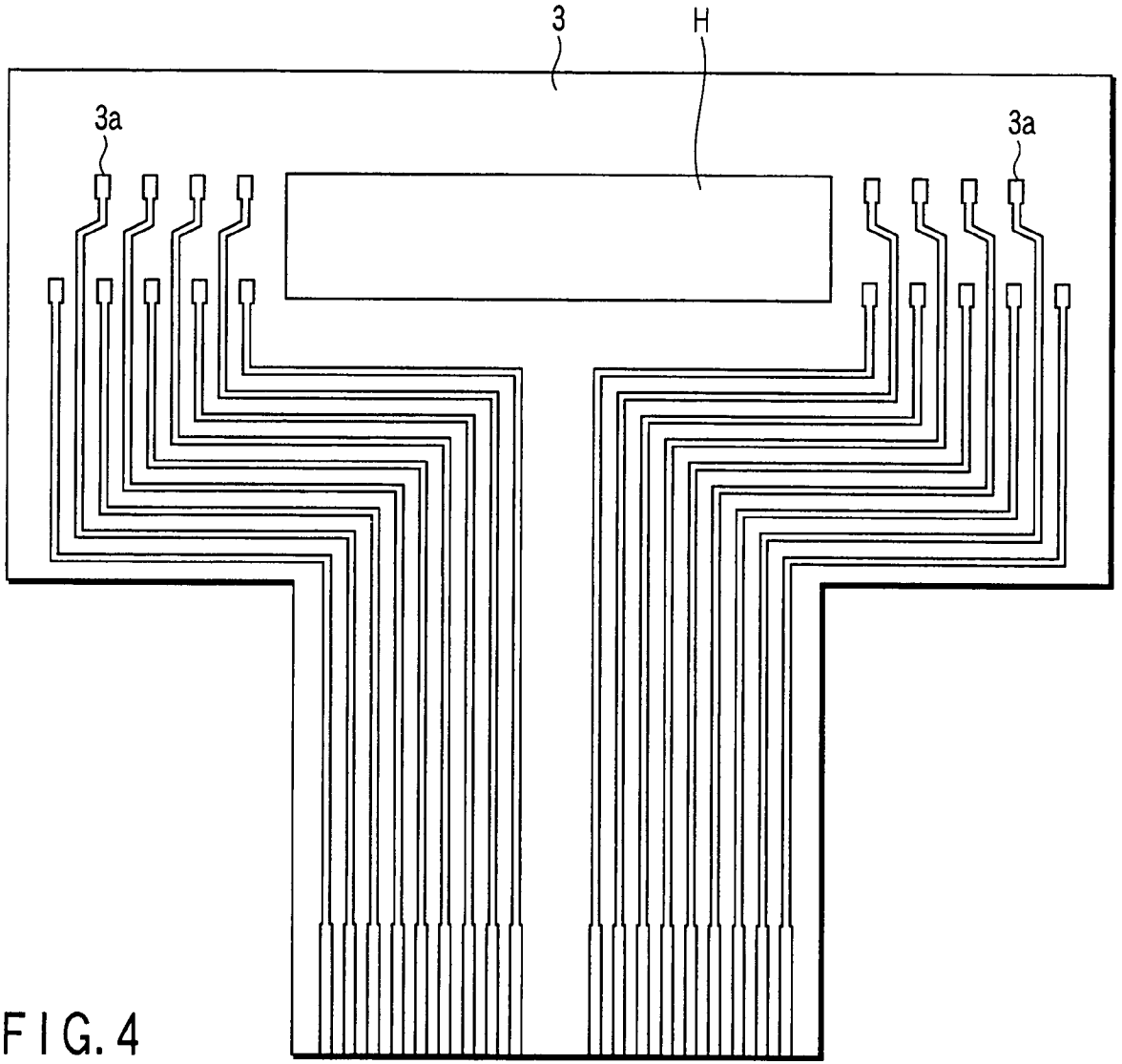
FIG. 4 is an appearance diagram showing one example of an FPC connected to the stacking connectors according to one embodiment of the present invention.
Figure 5:
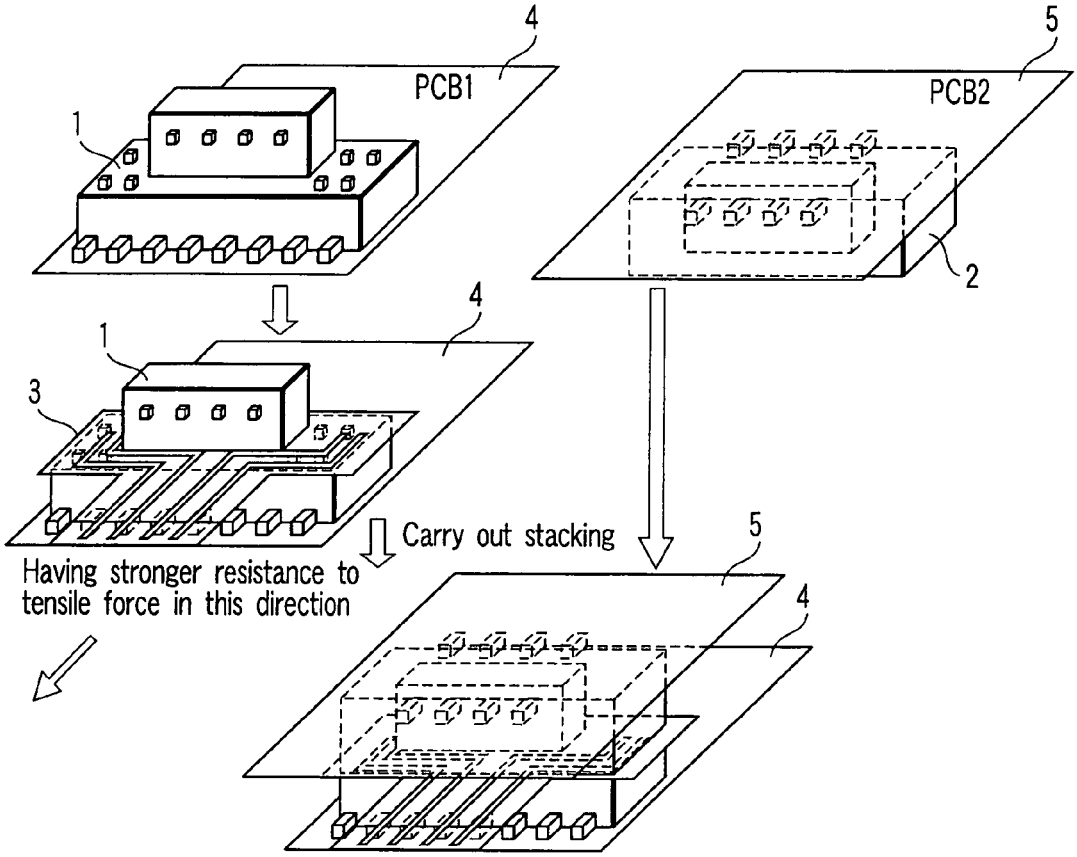
FIG. 5 is an explanatory diagram showing one example of fitting of the stacking connectors according to one embodiment of the present invention.
Figure 6:
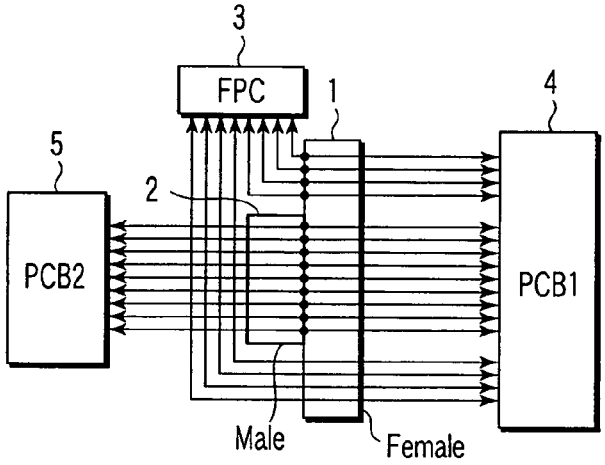
FIG. 6 is a circuit diagram showing one example of circuitry of the stacking connectors according to one embodiment of the present invention.
Figure 7:
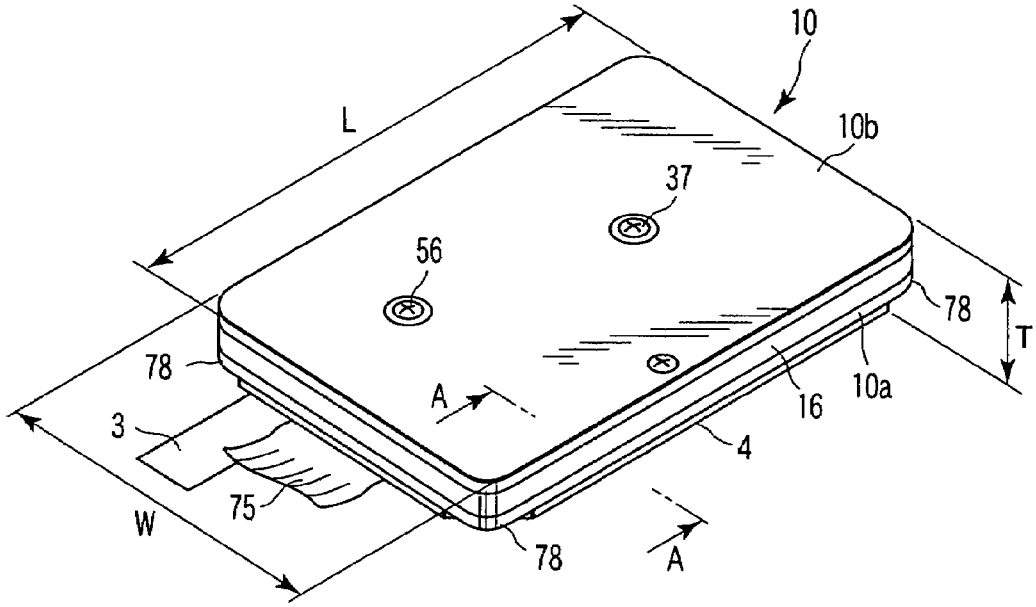
FIG. 7 is an appearance diagram showing one example of a hard disk device in which the stacking connectors according to one embodiment of the present invention are used for connection.
Figure 8:
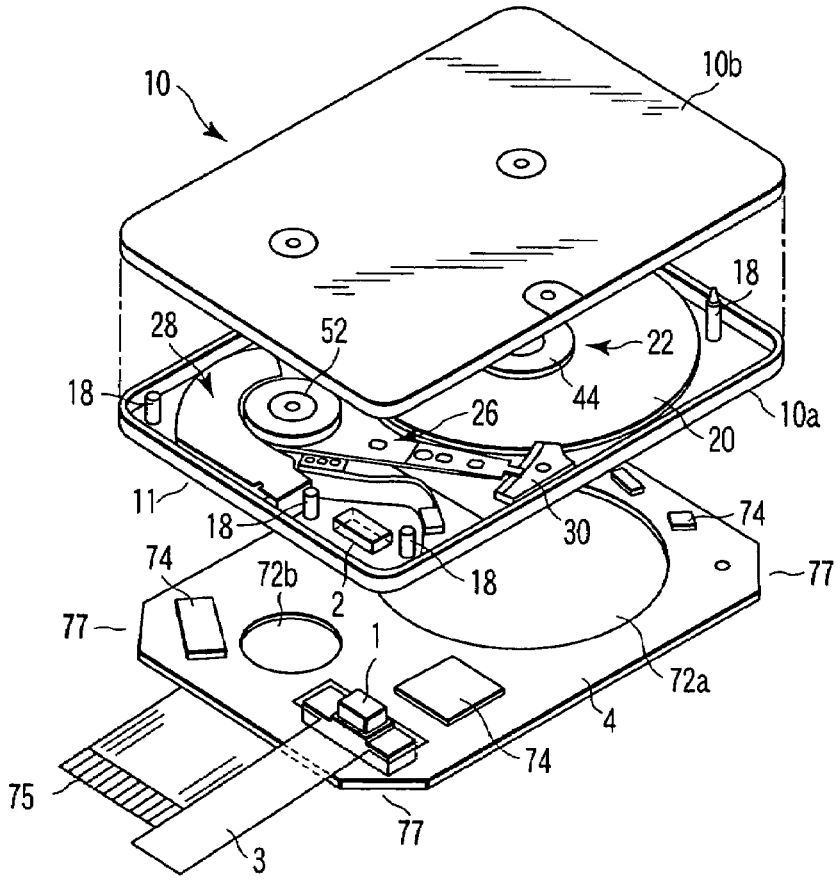
FIG. 8 is an exploded diagram showing one example of the hard disk device in which the stacking connectors according to one embodiment of the present invention are used for connection.
Figure 9:
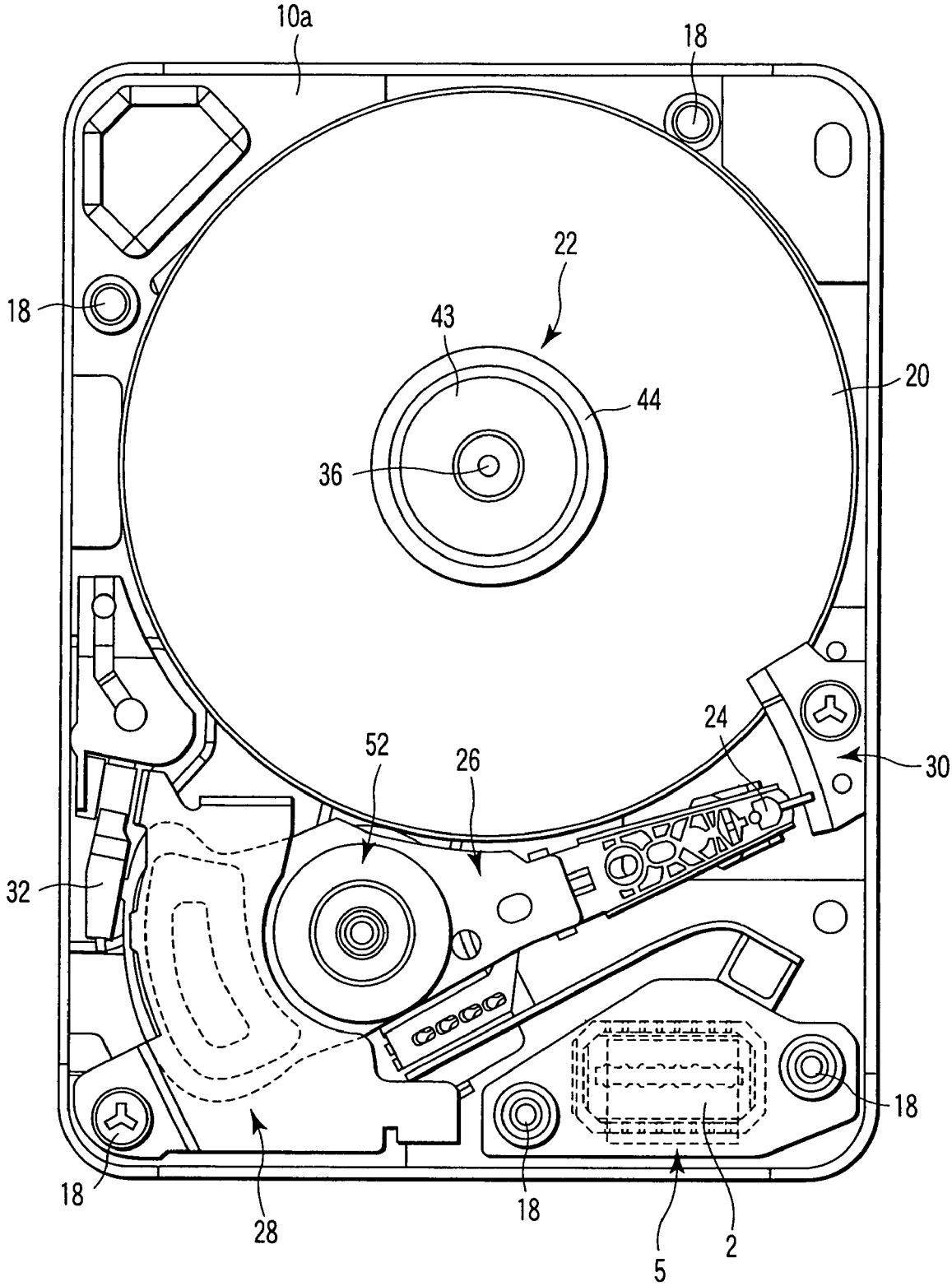
FIG. 9 is an exploded diagram showing one example of the hard disk device in which the stacking connectors according to one embodiment of the present invention are used for connection.
Figure 10:
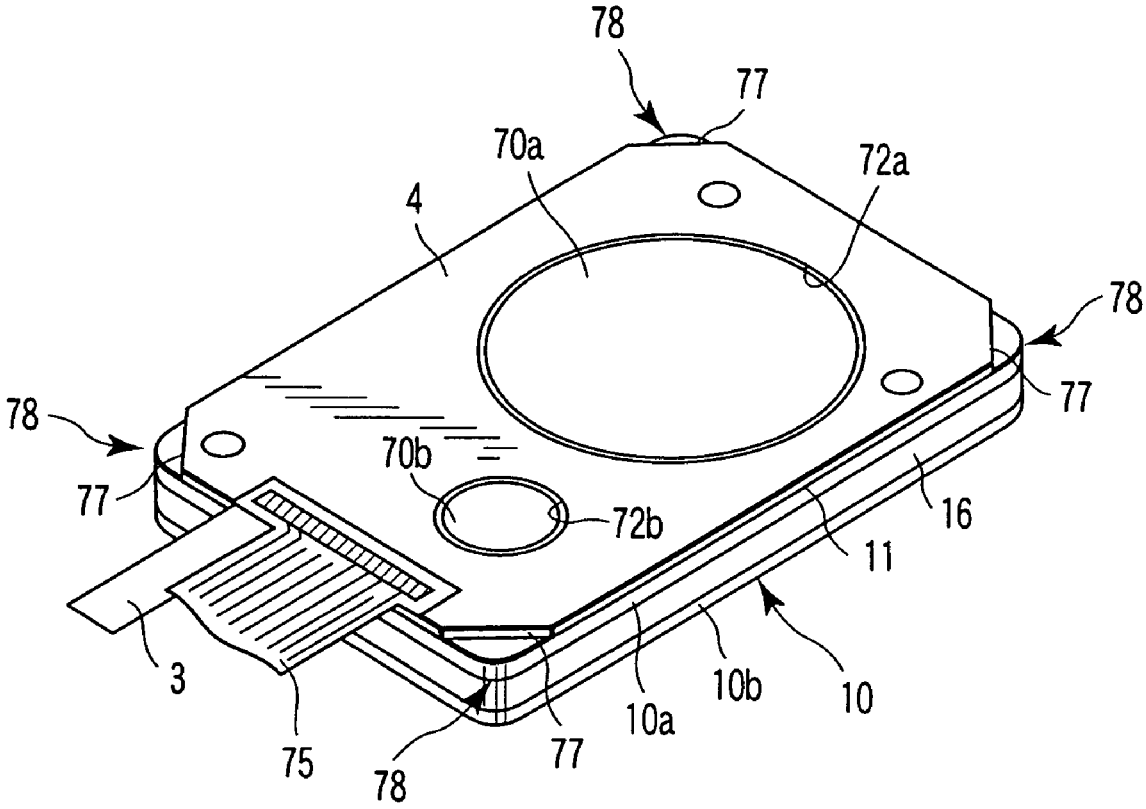
FIG. 10 is an exploded diagram showing one example of the hard disk device in which the stacking connectors according to one embodiment of the present invention are used for connection.

FIG. 1 is an appearance diagram showing one example of stacking connectors according to one embodiment of the present invention. FIG. 2 is an appearance diagram showing one example of a male stacking connector in the same way. FIG. 3 is an appearance diagram showing one example of a female stacking connector in the same way. FIG. 4 is an appearance diagram showing one example of an FCP connected to the stacking connectors in the same way. FIG. 5 is an explanatory diagram showing one example of fitting of the stacking connectors in the same way. FIG. 6 is a circuit diagram showing one example of circuitry of the stacking connectors in the same way. FIG. 7 is an appearance diagram showing one example of a hard disk device in which the stacking connectors are used for connection in the same way. FIG. 8 is an exploded diagram showing one example of the hard disk device in the stacking connectors are used for connection in the same way. FIG. 9 is an exploded diagram showing one example of the hard disk device in which the stacking connectors are used for connection in the same way. FIG. 10 is an exploded diagram showing one example of the hard disk device in which the stacking connectors are used for connection in the same way.

<Connector System according to One Embodiment of the Invention>

(Structure)

First, a connector system according to one embodiment of the present invention will be describe with reference to FIGS. 1 to 4. The connector system according to one embodiment of the present invention is structured from a male connector unit 1, a female connector unit 2, and a flexible printed circuit board 3.

The connector system formed from those has, as will be described later in FIG. 6, a connect function (a terminal group a) of connecting two printed circuit boards 4 and 5 so as to be n-to-n, and a connect function (a terminal group b) of connecting the flexible printed circuit board 3 and the one printed circuit board 4.

Here, the male connector unit 1 has, as one specific example, as shown in an example of 36 pins of FIG. 2, a main body part 1*a* and a convex part 1*b*. The convex part 1*b* has a total of 18 pin terminals 1*d* on the front face and the back face used for a connection between the printed circuit boards 4 and 5. The main body part 1*a* has pin terminals 1*f* on a contact face 1*e*. The number of the pin terminals 1*f* is a total of 18 pins which are, as one example, provided so as to be divided into right and left.

Further, the main body part 1*a* has pin terminals 1*hd* and pin terminal 1*hf*.

A total of 18 pin terminals 1*hd* are provided on the central portion at the front face side and on the central portion at unillustrated back face side of the main body part 1*a* for connecting to the printed circuit board 4 which will be described later. Further, the pin terminals 1*hd* are electrically connected to the pin terminals 1*d* used for a connection between the printed circuit board 4 and the printed circuit board 5.

A total of 18 pin terminals 1*hf* are provided on the right and left at the front face side and on the right and left at unillustrated back face side of the main body part 1*a* for connecting to the printed circuit board 4 which will be described later. Further, the pin terminals 1*hf* are electrically connected to the pin terminals 1*f*.

The female connector unit 2 has, as one specific example, as shown in an example of 18 pins of FIG. 3, a main body part 2*a* and a convex part 2*b*. 18 pin terminals 2*c* are provided on the front and back faces inside the convex part 2*b* for connecting to the printed circuit board 5 which will be described later. Accordingly, due to the convex part 1*b* of the male connector unit 1 being fitted into the convex part 2*b*, the pin terminals 1*d* provided on the front and back of the convex part 1*b* and the pin terminals 2*c* corresponding thereto contact each other to be electrically connected to one another.

The flexible printed circuit board 3 has joining terminals 3*a*. A hole part H is mounted to the convex part 1*b* of the male connector unit 1 such that the joining terminals 3*a* face the pin terminals 1*f*. Namely, the joining terminals 3*a* are provided at positions so as to be electrically connected to the pin terminal 1*f* of the male connector unit 1 by being mounted between the male connector unit 1 and the female connector unit 2.

In the present embodiment, as a concrete example, the joining terminals between the printed circuit boards are 18 pins and the joining terminals between the printed circuit board and the flexible printed circuit boards are 18 pins. However, the mode of the present invention is not limited to these numbers of contact pins, and can be applied to embodiments with various numbers of pins.

(Joining Method)

The connection among these male connector unit 1, female connector unit 2, and flexible printed circuit board 3 will be described hereinafter by using FIGS. 5 and 6.

The male connector unit 1 is connected by the printed circuit board 4 and the pin terminals 1*hf* and 1*hd*. The convex part 1*b* of the male connector unit 1 is inserted into the hole part H of the flexible printed circuit board 3, and the flexible printed circuit board 3 is mounted between the male connector unit 1 and the female connector unit 2. Further, the female connector unit 2 is connected to the printed circuit board 5 with the pin terminals 2*d*. Namely, the convex part 1*b* of the male connector unit 1 and a concave part 2*h* of the female connector unit 2 are fitted into by a predetermined fitting force. The contact face 1*e* and a contact face 2*e* are pressure-welded by this fitting, and a connection between the joining terminals 3*a* of the flexible printed circuit board 3 provided between the contact faces 1*e* and 2*e*, and the pin terminals 1*f* is assured.

The reliability of the connection is high because of the following reason. Namely, the flexible printed circuit board 3 is capable of countervailing against a tensile force in a vertical direction by the fitting between the contact faces 1*e* and 2*e*, which assures the connection. Further, because the convex part 1*b* of the male connector unit 1 is inserted into the hole part H, it is hard to bring about misregistration in a horizontal direction. Accordingly, it is hard to bring about misconnection due to misregistration between the joining terminals 3*a* and the pin terminals 1*f*. Moreover, an effect that the connector has higher resistance to vibration/impact as compared with joining of a conventional FPC connector can be obtained.

In accordance therewith, as compared with a conventional system using two of a stacking connector and an FPC connector, there is an effect that it is possible to reduce the parts cost and the mounting area, and the number of fitting is reduced from two to one.

It can be understood from FIG. 6 that a connection between the two printed circuit boards 4 and 5, and a connection between the flexible printed circuit board 3 and the printed circuit board 4 are achieved by the connector system.

Further, in accordance with the connector system according to the present invention, it is possible to stably utilize a flexible printed circuit board with a great number of terminals (18 pins in the case of FIGS. 2 to 4). In accordance therewith, it is possible to extract many signals outwardly from the printed circuit board 4.

Accordingly, even in cases of partial alteration in electronic devices, the two printed circuit boards 4 and the like are not fully redesigned/remanufactured in each case, and by improving the flexible printed circuit board or an unillustrated circuit substrate or the like to which the flexible printed circuit board is connected, it is possible to easily rework. Accordingly, in accordance with the connector system according the present invention, it is possible to carry out improvements in electronic devices at low cost.

(Packaging into Small-scale Hard Disk)

Next, a case in which those connector systems are mounted into actual electronic devices will be described hereinafter by using the drawings. Here, for example, a case in which the connector system is mounted into a 0.85-inch hard disk drive will be described by using FIGS. 7 to 10.

As shown in FIGS. 7 and 8, the HDD has a substantially rectangular box-shaped case 10 in which various members which will be described later are housed, and a rectangular-shaped control circuit substrate 4 described above, which is provided so as to be overlapped onto the outer surface of the case 10. The case 10 and the control circuit substrate 4 are formed such that, for example, a length L is 32 mm and a width W is 24 mm, and a thickness T including the case and the control circuit substrate is 3 to 6 mm. A thickness T is set to be, for example, about 3.3 mm to 5 mm in accordance with the number of disks to be housed.

As shown in FIGS. 8 to 10, the case 10 has a first shell 10*a* and a second shell 10*b* which are formed so as to respectively have dimensions substantially equivalent to one another. The first and second shells 10*a* and 10*b* are respectively formed in a substantially rectangular shape from metal, and side walls are provided upright at the peripheral portions thereof. The first and second shells 10*a* and 10*b* are disposed so as to face one another in a state in which the peripheral portions thereof face one another. A strip-shaped sealing material 16 is wrapped around the peripheral portions of the first and second shells 10*a* and 10*b*, the peripheral portions are connected to one another with the sealing material 16, and the space between the peripheral portions is sealed. In accordance therewith, the rectangular box-shaped case 10 is structured.

The bottom face of the first shell 10*a* forms a rectangular mounting face 11. Four corners of the case 10 including the corners of the mounting face 11 are formed so as to be rounded to be circular shapes. In accordance therewith, the sealing material 16 wrapped around the peripheral portions of the case 10 is prevented from being damaged by the corners of the case, and the airtightness is prevented from being deteriorated by floating of the sealing material.

In the case 10, a plurality of supporting posts 18 are provided at the peripheral portions of the case. The respective supporting posts 18 have base end portions fixed to the inner face of the first shell 10*a*, and are provided upright so as to be substantially vertical to the inner face of the first shell. Screw holes are formed at the positions of the respective supporting posts 18 in the mounting face 11, which run up to the inside of the supporting posts.

As shown in FIGS. 7 and 8, the control circuit substrate 4 which is a printed circuit board has a rectangular shape with a length and a width which are substantially equivalent to those of the mounting face 11 of the case 10. A circular convex part 70*a* corresponding to a spindle motor 22 and a circular convex part 70*b* corresponding to a bearing assembly 52 are respectively formed at the mounting face 11 of the case 10. Circular openings 72*a* and 72*b* respectively corresponding to these convex parts 70*a* and 70*b* are formed at the control circuit substrate 4. The four corner portions of the control circuit substrate 4 are respectively cut out obliquely at, for example, an angle of 45° with respect to the respective sides, which respectively form cutout portions 77.

On the inner face of the control circuit substrate 4, i.e., on the plane facing the case 10, a plurality of electronic parts 74 and the male connector 1 described above are mounted. The flexible printed circuit board 3 for electrically connecting the HDD described above to an external device is mounted onto the convex part 1*a* of the connector 1, and is led out from the short side of the control circuit substrate 4 to the outside. Further, a flexible printed circuit board 75 directly connected to the control circuit substrate 4 is favorably provided separately. However, only the flexible printed circuit board 3 may be provided.

The control circuit substrate 4 formed in the above-described way is disposed so as to be overlapped on the mounting face 11 of the case 10, and is screwed on the first shell 10*a* by a plurality of screws. At this time, the control circuit substrate 4 is disposed in a state in which the four sides thereof are respectively kept in lines with the four sides of the mounting face 11, i.e., in a state in which the four sides thereof are coincident with the four sides of the mounting face 11. The convex parts 70*a* and 70*b* formed on the mounting face 11 are respectively disposed in the openings 72*a* and 72*b* of the control circuit substrate 4. The male connector 1 mounted on the control circuit substrate 4 is fitted into the female connector 2 connected to the printed circuit board 5 shown in FIG. 9.

The cutout portions 77 formed at the four corner portions of the control circuit substrate 4 are respectively positioned at the four corner portions of the mounting face 11. In accordance therewith, the four corner portions of the mounting face 11 are not covered with the control circuit substrate 4, and are exposed to the outside. The corner portions of the case 10 including the exposed four corner portions of the mounting face 11 respectively structure holding portions 78 for holding the case without contacting the control circuit substrate 4.

In the case 10, there are housed: a magnetic disk 20 with a diameter of, for example, 0.85 inches which functions as an information storage medium; a spindle motor 22 serving as a driving motor which supports and rotates the magnetic disk; a magnetic head 24 carrying out writing and reading of information with respect to the magnetic disk; a head suspension assembly (hereinafter called an HSA) 26 which supports the magnetic head so as to be freely movable with respect to the magnetic disk 20; a voice coil motor (hereinafter called a VCM) 28 which rotates and positions the HSA; a ramp load mechanism 30 which unloads and retains the magnetic head at a position spaced from the magnetic disk when the magnetic head moves to the peripheral portion of the magnetic disk; an electromagnetic latch 32 which holds the HSA at a withdrawn position; and a substrate unit 34 having a head amplifier and the like.

The spindle motor 22 is attached to the first shell 10*a*. The spindle motor 22 has an axis 36, and the axis is fixed to the inner face of the first shell 10*a* and is provided upright so as to be substantially vertical to the inner face. The extended end of the axis 36 is screwed on the second shell by a setscrew 37 screwed into from outside of the second shell 10*b*. In accordance therewith, the axis 36 is supported so as to be held at the both sides by the first and second shells 10*a* and 10*b*.

Further, the bearing assembly 52 functioning as a bearing unit has an axis 53 provided upright so as to be vertical to the inner face of the first shell 10*a*, and a cylindrical hub 54 supported so as to be rotatable by the axis 53 via a pair of bearings. The extended end of the axis 53 is screwed on the second shell by a setscrew 56 screwed into from outside of the second shell 10*b* (refer to FIG. 7). In accordance therewith, the axis 53 is supported so as to be held at the both sides by the first and second shells 10*a* and 10*b*.

A rotor is supported to the axis 36 via an unillustrated bearing so as to be rotatable. The end portion of the rotor at the second shell 10*b* side structures a cylindrical hub 43, and the magnetic disk 20 is fitted into the hub concentrically. A ring-shaped clamp ring 44 is fitted into the end portion of the hub 43, which retains the circumferential peripheral portion of the magnetic disk 20. In accordance therewith, the magnetic disk 20 is fixed to the rotor, and is supported so as to be rotatable integrally with the rotor.

In this way, the connector system according to the present invention can be applied to an electronic device such as the hard disk drive 10 or the like, and there is provided a connector system in which a great number of connection terminals to a flexible printed circuit board are provided, and it is possible to connect the flexible printed circuit board with high strength.

Further, since the contact pins of the flexible printed circuit board are expanded in a horizontal direction, as compared with a case in which the connections of the flexible printed circuit board are disposed at the connecting side faces of the connector, it is possible to lower a height even after the connector is connected.

In accordance with the various embodiments described above, the skilled in the art can realize the present invention. However, it is easy for those skilled in the art to further conceive of various modified examples of these embodiments, and the present invention can be applied to various embodiments without inventive ability. Accordingly, the present invention extends over a broad range which does not contradict the disclosed principles and the novel features, and is not limited to the embodiments described above.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A connector system comprising:

a male connector unit having a main body and a convex part the convex part having first pin terminals, the male connector main body having second pin terminals provided on a contact face, the contact face of the male connector main body being configured to contact a corresponding contact face of female connector main body of a female connector unit when the male and female connector units are coupled, the male connector main body further having a plurality of third pin terminals provided on side faces different from the contact face of the male connector main body, each of the plurality of third pin terminals being electrically connected to a corresponding one of the first pin terminals or the second pin terminals, wherein the female connector unit has a main body and a concave part, the concave part being configured to couple with the convex part of the male connector unit, the concave part having fourth pin terminals configured to contact the first pin terminals when the convex part of the male connector unit and the concave part of the female connector unit are coupled, the female connector body having fifth pin terminals provided on side faces different from the contact face of the female connector main body, each of the fifth pin terminals being electrically connected to corresponding ones of the fourth pin terminals.

2. The connector system according to claim 1, wherein the number of the first pin terminals is 18,the number of the second pin terminals is 18, the number of the third pin terminals is 36 the number of the fourth pin terminals is 18, and the number of the fifth pin terminals is 18.

3. A packaging structure comprising:

a male connector unit having a main body and a convex part the convex part having first pin terminals, the male connector main body having second pin terminals provided on a contact face, the contact face of the male connector main body being configured to contact a corresponding contact face of a female connector main body of a female connector unit when the male and female connector units are coupled, the male connector main body further having a plurality of third pin terminals provided on side faces different from the contact face of the male connector main body, each of the plurality of third pin terminals being electrically connected to a corresponding one of the first pin terminals or the second pin terminals, wherein the female connector unit has a main body and a concave part, the concave part being configured to couple with the convex part of the male connector unit, the concave part having fourth pin terminals configured to contact the first pin terminals when the convex part of the male connector unit and the concave part of the female connector unit are coupled, the female connector body having fifth pin terminals provided on side faces different from the contact face of the female connector main body, each of the fifth pin terminals being electrically connected to corresponding ones of the fourth pin terminals;

a flexible printed circuit board which has a main body substrate, a hole provided in the main body substrate and into which the convex part of the male connector unit can be fitted, and joining terminals provided at positions on the main body substrate that correspond to the second pin terminals of the male connector unit when the convex part of the male connector unit is fitted into the hole part;

a first substrate connected to the third pin terminals of the male connector unit; and a second substrate connected to the fifth pin terminals of the female connector unit.

4. The packaging structure according to claim 3, wherein the number of the first pin terminals is 18 the number of the second pin terminals is 18, the number of the third pin terminals is 36 the number of the fourth pin terminals is 18, the number of the fifth pin terminals is 18, and the number of the joining terminals of the flexible printed circuit board is 18.

5. An electronic device comprising:

an electronic device protected by a chassis;

a male connector unit having a main body and a convex part the convex part having first pin terminals, the male connector main body having second pin terminals provided to on a contact face, the contact face of the male connector main body being configured to contact a corresponding contact face of a female connector main body of a female connector unit when the male and female connector units are coupled, the male connector main body further having a plurality of third pin terminals provided on side faces different from the contact face of the male connector main body, each of the plurality of third pin terminals being electrically connected to a corresponding one of the first pin terminals or the second pin terminals, wherein the female connector unit is configured to be provided at opening portions of the chassis of the electronic device, and wherein the female connector unit has a main body and a concave part, the concave part being configured to couple with the convex part of the male connector unit, the concave part having fourth pin terminals configured to contact the first pin terminals when the convex part of the male connector unit and the concave part of the female connector unit are coupled, the female connector body having fifth pin terminals provided on side faces different from the contact face of the female connector main body, each of the fifth pin terminals being electrically connected to corresponding ones of the fourth pin terminals;

a flexible printed circuit hoard which has a main body substrate, a hole provided in the main body substrate and into which the convex part of the male connector unit can be fitted, and joining terminals provided at positions on the main body substrate that correspond to the second pin terminals of the male connector unit when the convex part of the male connector unit is fitted into the hole part;

a first substrate connected to the third pin terminals of the male connector unit; and a second substrate which is connected to the fifth pin terminals of the female connector unit, and is disposed inside the chassis of the electronic device.

6. The electronic device according to claim 5, wherein the number of the first pin terminals is 18, the number of the third pin terminals is 36 in the male connector unit, the number of the fourth pin terminals is 18, the number of the fifth pin terminals is 18, and the number of the joining terminals of the flexile printed circuit board 18.

* * * * *